US006951033B2

(12) United States Patent
Dainese

(10) Patent No.: US 6,951,033 B2
(45) Date of Patent: Oct. 4, 2005

(54) MULTI PARTS PROTECTIVE GARMENT FOR MOTORBIKERS

(75) Inventor: Lino Dainese, Molvena (IT)

(73) Assignee: Dainese S.p.A., Molvena (IT)

( * ) Notice: Subject to any disclaimer, the term of this patent is extended or adjusted under 35 U.S.C. 154(b) by 100 days.

(21) Appl. No.: 10/363,133

(22) PCT Filed: Sep. 5, 2001

(86) PCT No.: PCT/IT01/00460

§ 371 (c)(1),
(2), (4) Date: Jun. 16, 2003

(87) PCT Pub. No.: WO02/19850

PCT Pub. Date: Mar. 14, 2002

(65) Prior Publication Data

US 2004/0111790 A1 Jun. 17, 2004

(30) Foreign Application Priority Data

Sep. 6, 2000 (IT) ..... RM2000A0483

(51) Int. Cl.[7] ..... A41D 13/00
(52) U.S. Cl. ..... 2/69; 2/DIG. 3
(58) Field of Search ..... 280/728.1, 730.1; 2/456, 363–465, 2.11, 2.14, 468, 60, 252, 69, 69.5, 92, 102, 108, 126, DIG. 3; 441/87, 88, 102, 106, 90, 108

(56) References Cited

U.S. PATENT DOCUMENTS

| | | | | | |
|---|---|---|---|---|---|
| 3,878,561 | A | * | 4/1975 | Winiecki | 2/461 |
| 3,930,667 | A | * | 1/1976 | Osuchowski et al. | 280/730.1 |
| 4,059,852 | A | * | 11/1977 | Crane | 2/456 |
| 4,637,074 | A | * | 1/1987 | Taheri | 2/456 |
| 4,825,469 | A | * | 5/1989 | Kincheloe | 2/456 |
| 4,977,623 | A | | 12/1990 | DeMarco | |
| 4,984,821 | A | * | 1/1991 | Kim et al. | 280/728.1 |
| 5,746,442 | A | * | 5/1998 | Hoyaukin | 280/730.1 |
| 5,781,936 | A | * | 7/1998 | Alaloof | 2/456 |
| 5,867,842 | A | * | 2/1999 | Pinsley et al. | 2/462 |
| 6,298,487 | B1 | * | 10/2001 | Mayhew | 2/108 |
| 6,625,814 | B1 | * | 9/2003 | Veh | 2/102 |

FOREIGN PATENT DOCUMENTS

| | | |
|---|---|---|
| DE | 33 23 701 A | 1/1984 |
| DE | 195 26 641 A | 1/1997 |
| FR | 2 778 067 A | 11/1999 |
| FR | 2 802 778 A | 6/2001 |
| WO | WO 98/51175 A | 11/1998 |
| WO | WO 98/52433 A | 11/1998 |
| WO | WO 01/50897 A | 7/2001 |

* cited by examiner

*Primary Examiner*—Tejash Patel
(74) *Attorney, Agent, or Firm*—Birch, Stewart, Kolasch & Birch, LLP

(57) ABSTRACT

The present invention concerns a multi parts garment having multiple means for the protection of motor bikers and/or of athletes practicing various sports against traumas from accidental falls and violent impacts; said garment has in cooperation a jacket having seam sections in preset tearing yarn, a gilet internally joined thereto and integrally associated to plural pockets in a fabric having a predetermined porosity and preset to be inflated by means of compressed gas bottles, which are advantageously overlapped, or adhering to a back protector protecting the spine and having a rigid polymeric structure, and an electronic unit, receiving pulses from acceleration sensors between the motor biker and the motor vehicle.

18 Claims, 5 Drawing Sheets

MULTI PARTS PROTECTIVE GARMENT FOR MOTORBIKERS

This application is the national phase under 35 U.S.C. §371 of PCT International Application No. PCT/ITO1/00460 which has an International filing date of Sep. 5, 2001, which desigated the United States of America.

BACKGROUND OF THE INVENTION

1. Field of the Invention

The present invention concerns a multi part garment having multiple means for the protection of a user against traumas and fractures from accidental falls and/or violent impacts against obstacles, in particular for motor bikers, or for athletes practicing hazardous sports.

More precisely, the present invention concerns a jacket equipped with an electronic card or unit bearing a display, said unit being coupled to a gilet concurrently forming with its equipment the structure of parts and means for an effective motor biker's protection.

2. Description of the Prior Art

It is already known that garments, above all garments for sport people, are manufactured with materials and component parts having hi-tech features in order to provide the user with a wide range of possible, essentially multi parts, compositions, according to the needs and safety thereof.

Along with the use of specific materials, also the shapes and the structure of the garments are actually implemented to provide the user with utmost reliability and protection when using the garment in a specific sport. Evidently, the plurality of employs to which the garment is destined, together with the various user's needs, has determined specific functional features thereof, with the entailed manufacturers' commitment to innovative research. Moreover, the fact that each purchaser practicing certain activities, like, e.g., motor biking, mountaineering and riding, always tends to purchase therefor protective means related to personal safety, both accidentally and from a merely practical and functional viewpoint, should not be neglected. In fact, safety has recently become one of the main targets of research, through the study and the adoption of ever more sophisticated applications, and a foremost customer need.

It is actually known, that in the field of safety, the development of 'passive' safety devices, i.e., those apt to minimize the dangerous consequences on passengers in case of a vehicle, or motor vehicle, impact, received a substantial boost.

In the field of automotive vehicles, pneumatic systems with an air bag which, in case of a violent impact, is instantly inflated by means of a gas generator so as to interpose itself between the driver and the vehicle body or the steering wheel are widely used. These air bags have been mass-employed on automotive vehicles for quite some time, nowadays being widely marketed. Basically, to date the use of air bag, which became very popular in automotive vehicles, did not found a practical application and was not widely produced in the field of motor biking, since in the latter the modes of employ of such protections are radically different. As a matter of fact, in automotive vehicles the scope of the air bag is to limit the injuries caused by a frontal impact, preventing the passengers from being projected onwards, so that the operating direction of the protection is specifically defined and the sole problems are those of determining the optimum speed of response to the inflation of the air bag, and of having the latter remain inflated solely for a relatively short time interval, and then deflate. Thus, as it is well-known to those skilled in the art, in case of a passenger's impact, the air bag is not permanently or elastically deformed, which after the impact would make the passenger bounce back with a correspondingly great force. In the field of the motor vehicles, a motor biker impacting against obstacles or involved in accidental falls could be violently projected in any direction, whereas the protective action of the air bag, were the latter made integral to the motor vehicle structure, could develop in a sole direction, i.e., so as to project the motor biker upwards or in a predetermined direction, beyond the obstacle impacted onto by the motor vehicle, thereby remarkably limiting the safety protective action thereof.

In the state of the art the protection of the user against traumas and fractures from falls and/or impacts against obstacles, in particular for motor bikers, is implemented by means of passive safety devices; incidentally, jackets and suits, or likewise garments equipped with special padding which cushion the impact against obstacles or against the ground in case of falls have been implemented. These garments, due to the presence of several relevant padded areas for activating at least some safety, turn out to be impractical, when not altogether bulky, like, e.g., in those employs requiring an extreme nimbleness of body motion, just like that required by a motor biker. The state of the art is also aware of jacket-like garments entailing at least one thick air space.

The laid-open Patents UK1479733, UK1588919, U.S. Pat. No. 4,059,852 and U.S. Pat. No. 5,781,936 teach garments cushioning a wearer's impact, as the protectors comprise one or more inflatable bags adapted so as to form an impact-absorbing cushion.

However, such applications entail several drawbacks rendering limitative and unsatisfactory the application thereof. In particular, these drawbacks are represented by the umbilical connection between the inflatable protector worn onto the motor biker's torso and the motor vehicle frame. However, it is known that accidental impacts, or devastating falls to the ground, initially occur in a situation of union between the motor biker and the motor vehicle, i.e., without a mechanical tearing of the umbilical connection and, therefore, without triggering the required inflatable protection; therefore, the protections of said known applications are not ensured at all times. Moreover, these known applications, due to the presence of a tying cord between the structure of the motor vehicle frame and the inflation garment, prove to be of scanty practicality and comfort, if not altogether bulky and tricky, like, e.g., in an use requiring utmost nimbleness of body motion, just as that required by a motorbike runner, and, likewise, in the practice of everyday leisure and/or work motor biking activities.

In light of the above, it is apparent that the protective garments in use in the field of motor biking activities, as well as in other sports, like mountaineering, mountain biking and any other sports or working activity possibly entailing falls, are not sufficiently qualified to ensure an actual protection in case of any accident or hazardous condition. Moreover, those solutions are not appreciated by an user, due both to the mechanical operation via the pulling of a cord, which might be torn off in case the same user be tossed and/or separated from a structure, and to the bulkiness and inconvenience thereof in the activation/deactivation practice.

The latter aspect is the main cause of the lack of industrialization of the known applications.

SUMMARY OF THE INVENTION

The Applicant has considered the problem in its entirety, with the precise aim of contriving a multi parts garment having multiple means capable of providing a really integral protection to the user and having functional and application features capable of overcoming the drawbacks mentioned with reference to the known art.

The solution is that of designing a multi parts garment for a perfectly feasible and industrially manufacturable protection, garment apt to eliminate the situations causing serious inconveniences to the user. In fact, the advantage of the presently advanced garment, by means of an original solution, is to allow remarkable economic industrial benefits to the manufacturer and to ensure the users' appreciation and the high protection thereto.

Hence, an object of the present invention is to provide a multi parts protective garment capable of:

offering a protection using a traditional outfit which be directly applied onto the person to be protected in the various hazardous situations;

fully protecting the body areas subjected to a greater risk of permanent injuries;

allowing when normally worn minimum dimensions and freedom of movements to the wearer;

enabling to customize the protection, from a merely aesthetic viewpoint as well as from a purely practical and functional one;

attaining a substantial technological renewal in the field of the activities whose practices are accidentally subjected to serious injuries.

Another object of the present invention is to contrive a multi parts protective garment having high flexibility of use, providing the possibility of directly arranging it needwise, applying, taking off or modifying a part thereof, so as to vary at will the shape and/or the structure thereof to the user.

A further object of the present invention is to implement a multi parts protective garment having a high flexibility of use, which allow both the manufacturer and the distributor to separately store and manufacture the various component parts and means, thereby improving the management of the stores and of the stocks, further upgrading the customer service.

A further object of the present invention is to implement also a multi parts protective garment having a high flexibility of use, modifiable at will from a practical-functional viewpoint, so as to be employable in various sports, or for other uses, to this end making use of the same basic garment and optionally allowing the replacement of a damaged part thereof with no need to dispose of the entire multi parts protective garment for motor bikers.

Last but not least, a further object is to provide the multi parts garment having multiple means in a kit essentially consisting of three items: the jacket, the gilet and the back protector.

Therefore, the task underlying the invention is to indicate a protective structure which be simple to implement, as well as to implement a garment of utmost reliability providing faultless safety performances, and to generally eliminate the drawbacks and the disadvantages related to the provisions of the state of the art indicated above.

Hence, the present invention provides a multi parts protective garment having multiple means for a motor biker's protection against traumas and fractures from sudden and accidental falls, said garment having in cooperation:

A garment in form of a jacket, preset in a shape apt to house removable parts and means, said jacket having seam sections with yarn preset on specific breaking values to tearing tension in order to ensure the freedom of expansion of the fabric gathered in an underlying position to contain the underlying totally overlapping aligned pockets when the latter are subjected to a sudden inflation which tears off the yarn of the seams for enveloping the motor biker in an advantageous protection in presence of sudden detachments, or of devastating falls from the motor vehicle;

A gilet in flexible composite material, close-fitting and joined with removable zippers to the inner wall of the jacket and to said gilet. Onto the outer side of the jacket and therebetween, to which multiple pockets in a resisting double-walled fabric having a predetermined porosity are integrally associated, preferably three pockets, a central back-covering one and two side ones, each pocket being apt to house preselected active protection means entrenched and firmly positioned therein. Said gilet in the inner side being shaped with a central pocket astride of the spine with continuous-type zippers;

A back protector for protecting the spine, in a polymeric material having a substantially rigid structure, arranged in the inner central pocket of the gilet in a projection covering the vertebrae;

A plurality of sources of high-pressure gas, preferably inert gas, and with at least the presence of an individual source for each outer pocket of the gilet, said gas sources, or bottles, in their preset position advantageously relating to the underlying protective structure of the back protector, and at most advantageously overlapping onto the motor biker's body to obviate to hazardous compressions in presence of violent impacts against various sorts of obstacles;

An electronic unit integrally associated to the jacket and receiving pulses from acceleration sensors located between the motor biker and the motor vehicle, said sensors being inertia switch or magnetic retention mechanical sensors, or electronic-type, piezoelectric or piezoresistive sensors, which in the preferred laminar shape, or in the advantageous binary application thereof according to respectively orthogonal directions determine the exact direction of acceleration (deceleration?) in order to activate various means for defending the motor biker, not merely as a function of the acceleration gradient over time, but also according to the direction of impact;

A connecting circuit between the electronic unit and the pressurized gas sources present in the pockets of the gilet;

solenoid valves, one for each gas source, or compressed gas bottle, which, concomitantly activated by the electronic unit receiving a pulse from at least one of the acceleration sensors, allow the gas sources to trigger a sudden inflation of the pockets of the gilet which envelop the motor biker at the instant in which the latter is subjected to a violent impact or to an accidental fall causing a sudden separation thereof from the motor vehicle;

a sensor overriding device, or anyhow a structure disengaging device in order to prevent unnecessary structure operations in quiescent situations;

a display onto the wall of the jacket in a position accessible to the motor biker's field of vision for indicating and informing about the on-line state of the entire operative structure.

According to an embodiment, the fabric gathered in a location underlying the preset-tearing sections of the jacket and integrally joined to the latter by means of seams which allow to contain the inflated pockets, is an advantageously porous mesh-like fabric, in order to elastically stabilize the same sudden inflation.

According to a further embodiment, the double-wall inflatable pockets manufactured in a resisting fabric and integrally joined to the gilet are in a material having at least one area with a predetermined porosity for outletting the gas only when a certain pressure threshold in the air bag is exceeded, entailing a targeted outflow of the gas from the inflated pockets, in order to prevent that, in case of a motor biker's impact, said pockets deform merely elastically and, thereafter, repel the motor biker with a correspondingly great force.

According to a further embodiment, the gas sources, containing known inert gases under pressure, are small-sized bottles provided with coupling and releasing devices in the inflatable pockets of a balancing gilet.

According to a further embodiment, the textile material implementing the garments in form of the jacket and of the gilet has a composite structure with conductive fibers in a quantity such as to exhibit an uniform electrical continuity.

According to a further embodiment, fiber optics, or fiber optics sensors, are incorporated in the textile composite material of the jacket and of the gilet, and said fiber optics are connected to the optoelectronics instrumentation in order to allow the monitoring and the control of the optic signals traveling inside of the former, and carrying in real time information on the mechanical, physical and thermal parameters.

According to a further embodiment, the inlets and the outlets of the fiber optics from the gilet and/or the jacket product are protected with small rubber discs glued onto the surface of the latter in order to eliminate the difficulties related to the trimming for the modeling of the product in presence of fiber optics.

BRIEF DESCRIPTION OF THE DRAWINGS

The present invention will hereinafter be better illustrated by the detailed description of a preferred embodiment thereof, given by way of example and not for limitative purposes, making reference to the attached drawings, wherein.

Figure 1:
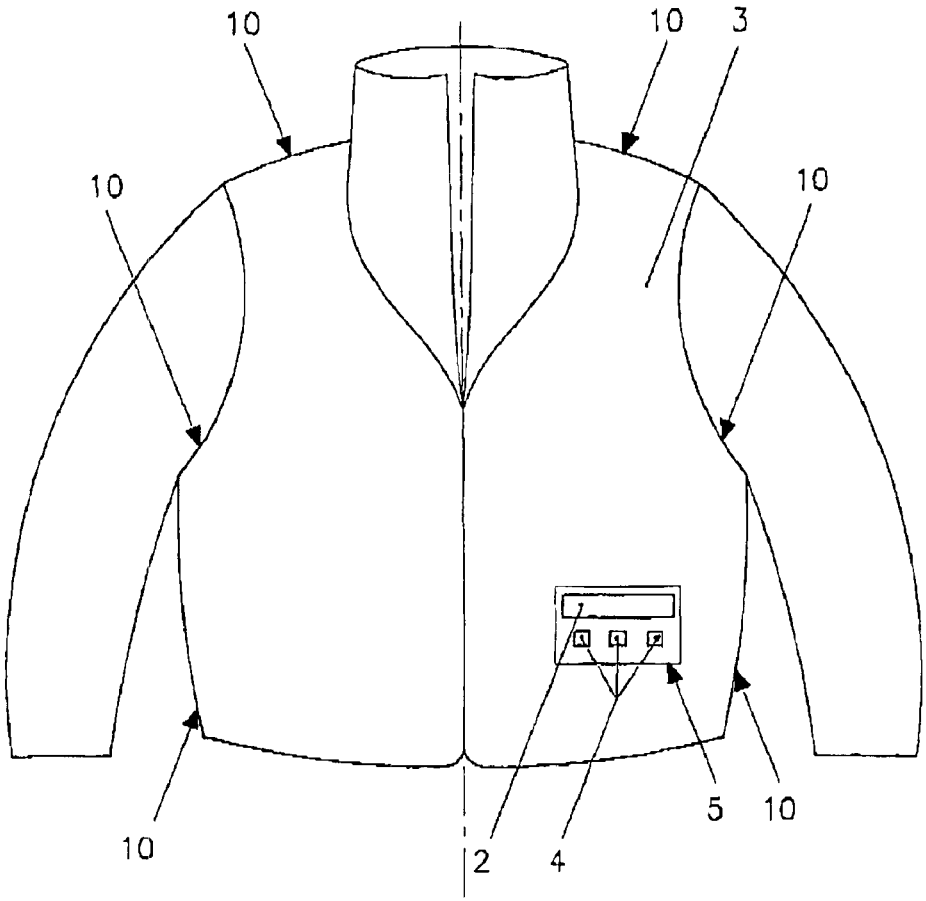
FIG. 1 is a schematic perspective view of the jacket comprising an electronic unit having a display and functional operation keys which is integrally associated to the former in a location accessible to the motor biker's field of vision.
Figure 2:
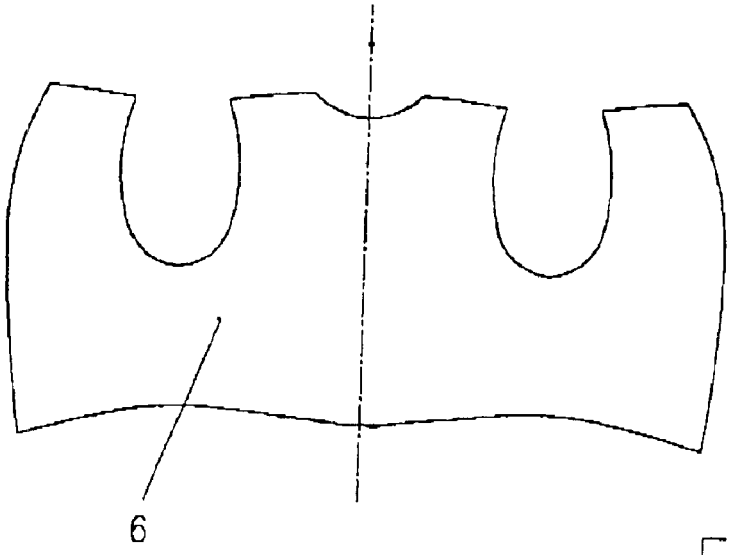
FIG. 2 is a schematic view of a gilet in a flexible composite material shown in a planar condition for a better disclosure of the contour thereof.
Figure 3:
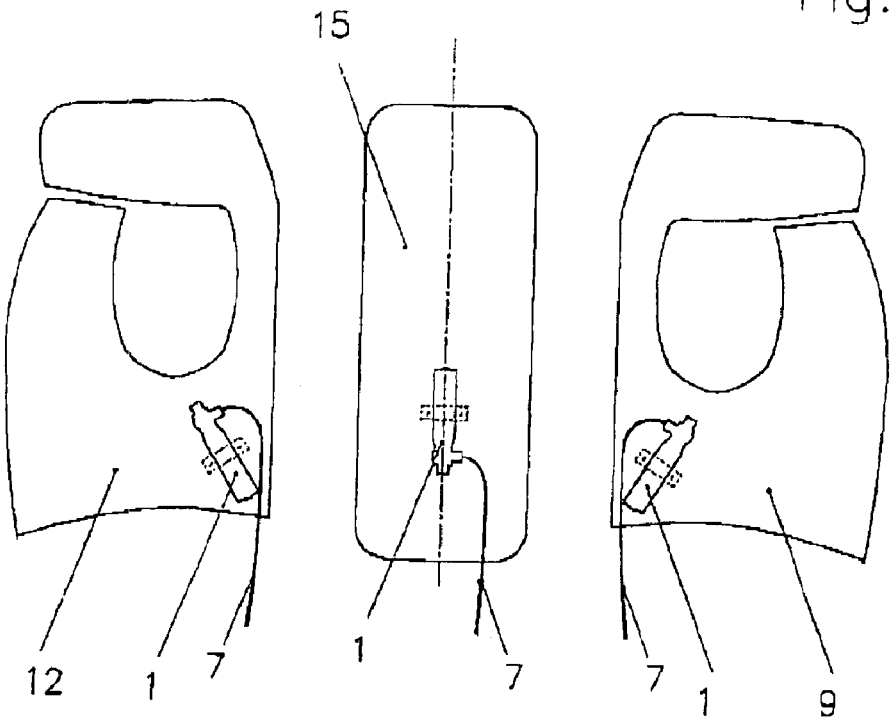
FIG. 3 is a view of three inflatable pockets in a resisting double-wall fabric, of which one is central and back-covering and two side ones housing gas generators.
Figure 4:
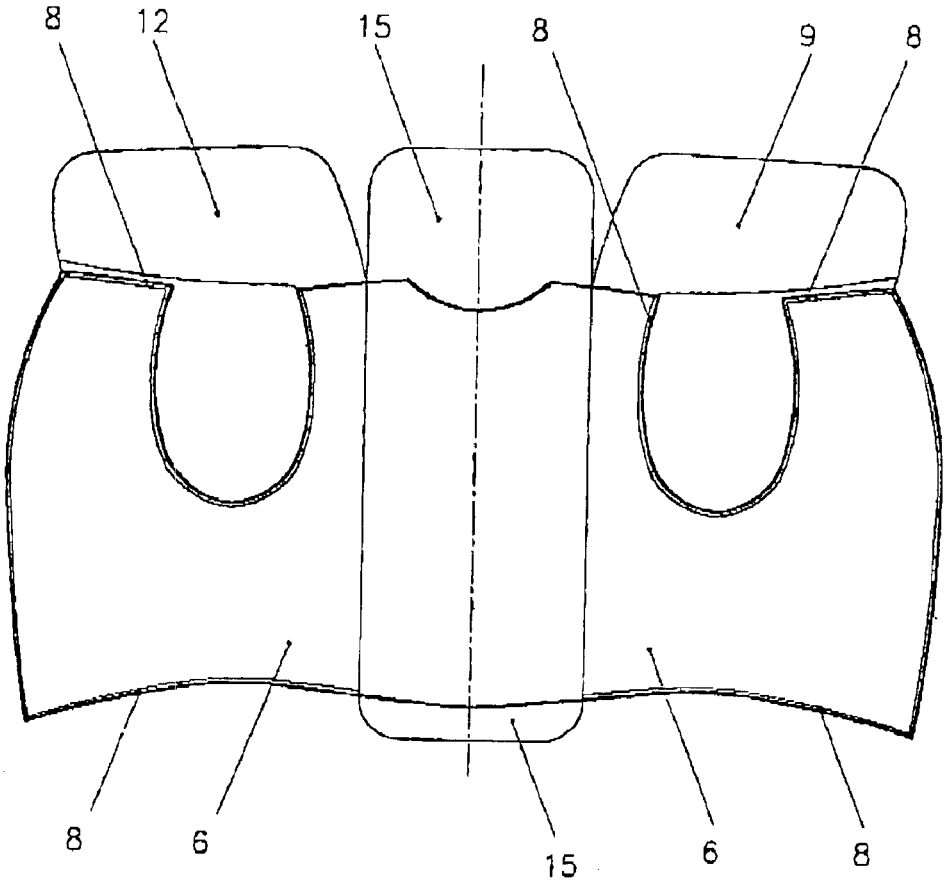
FIG. 4 is a schematic view of the gilet di FIG. 2 in a condition overlapped to the inflatable pockets of FIG. 3.
Figure 5:
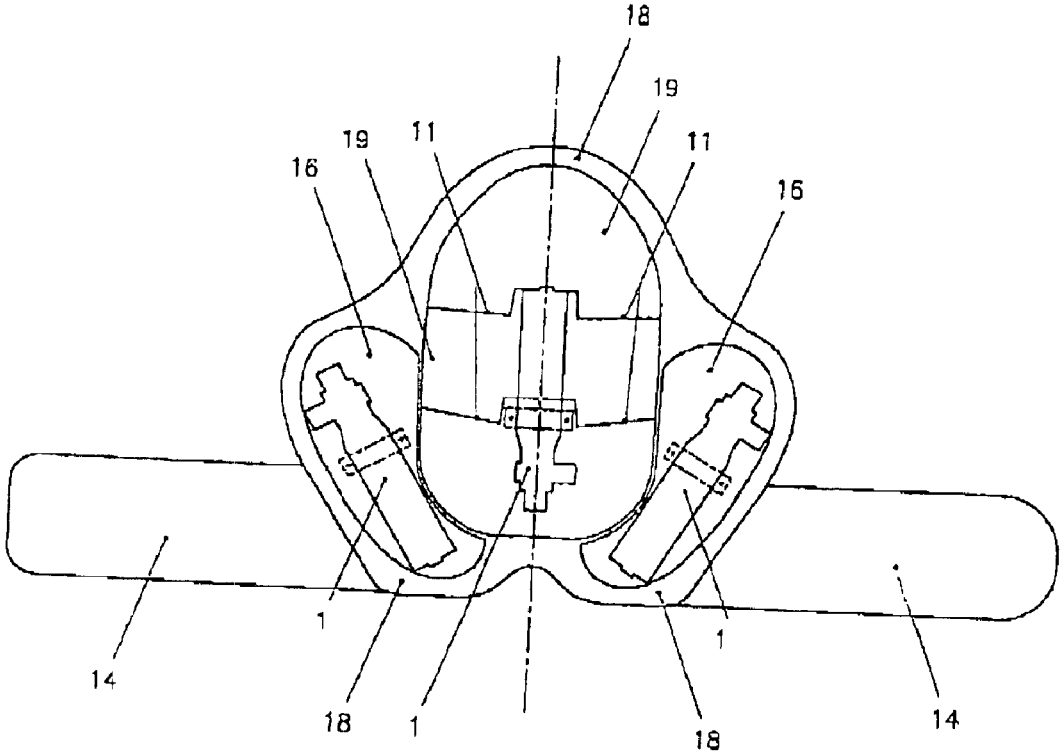
FIG. 5 is a schematic view of the back protector for the protection of the spine in which the arrangement of the inflation gas generators, as well as of the pockets stabilized with fastening members for the positioning thereof, and of a pair of bands preset to embrace the motor biker's body.
Figure 6:
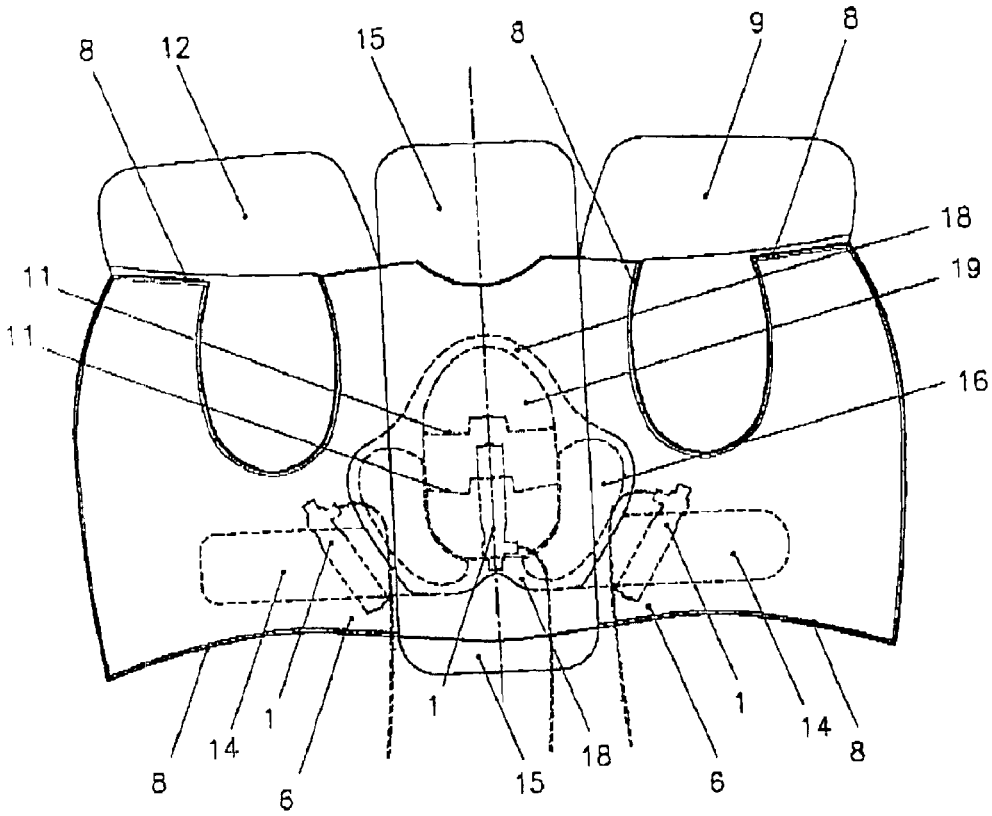
FIG. 6 is a schematic view of the associated assembly of the gilet of FIG. 2, of the inflatable pockets of FIG. 3 and of the back protector with the presence of the compressed gas sources of FIG. 5.

For simplicity's sake, in the figures corresponding and/or equivalent parts are provided with identical reference numbers. Likewise, for overall clarity, both the motor biker and the motorbike, which operate in mutual cooperation with the multi parts garment according to the present invention, are not illustrated, and therefore a description thereof will be omitted as superfluous for an understanding of the operation of the present invention.

DESCRIPTION OF THE PREFERRED EMBODIMENT

Making now reference to the figures, according to the present invention a jacket 3 providing a gas generator or source 1, e.g., of air, which is bottle-shaped and advantageously connected to coupling and releasing members inside of respective inflatable pockets 9, 12 and 15, is provided. Alternatively, the gas source 1 is fastenable with suitable belts to a back protector 18 apt to be arranged in a central pocket external to a balancing gilet 6 manufactured in a in flexible composite material and apt to form a part of the jacket 3.

In particular, the latter solution entails greater advantages, both practical and of comfort, and it certainly constitutes the preferred embodiment.

Moreover, a display 2 of an electronic unit 5 integrally associated to the jacket 3 in a location accessible to the motor biker's field of vision for indicating and informing about the on-line state of the entire protective structure, or for programming via respective push buttons 4 the various on-line functions, is provided. Between the solenoid valve of the compressed air generator 1 and the electronic unit 5 a connecting cable 7 is provided.

Furthermore, the unit 5 is apt to receive pulses from a plurality of acceleration sensors located onto the jacket 3 and/or onto the motorbike (not shown in the figures) for activating an electric signal to the solenoid valves of the gas generators 1 so as to trigger a sudden inflation of the pockets 9, 12 and 15 in the instant in which the motor biker is subjected to a violent impact, or to an accidental fall. Sometimes, and advantageously, the cables 7, may be replaced by fiber optics, or fiber optics sensors, inside of the textile composite material, in preset garment areas. E.g., according to such preferred embodiment of the present invention, it is provided that the textile composite material be a laminate in polymeric matrix carbon fiber which simplifies and improves the manufacturing process of structures in composite material like the structure made of the jacket 3, the gilet 6 and the supporting base 18 of a back protector 19, the whole incorporating fiber optics.

All this finds an advantageous application mostly in structures having a minimum weight, high structural efficiency and quality improvement. Incidentally, the fiber optics should be connected to the optoelectronics instrumentation of the unit 5 in order to analyze the optic signals, outputted from the sensors and traveling inside the fibers, which carry necessary parameter-related information.

According to the present invention, seam sections 10 preset on a tension value apt to allow the breaking of the connecting seams between the composite parts of the jacket 3 in order to provide freedom of expansion to the pockets 9, 12 and 15 integral to the gilet 6 in the instant in which said pockets are being inflated, in order to activate the protection of the motor biker in the instant where the latter is in presence of a sudden and devastating fall from a motor vehicle, are provided.

On the other hand, always onto the jacket 3, continuous seam sections 8 in form of resisting seams for the integral union between the gilet 6 and the inflatable pockets 9, 12 and

15, of a resisting double-wall fabric having a predetermined porosity in a state of tension generated by exceeding a pressure threshold value during the inflation, are provided.

Furthermore, the back protector components 16 and 19 for protecting the spine, preferably made in polymeric material, having a substantially rigid structure, and advantageously integrally supported on a base 18 in a sufficiently soft composite material, are provided. The wearability of the back protector thus implemented is ensured by means of bands 14 preset to embrace the motor biker's body in order to stabilize the entire protective structure.

The components 16 and 19 protecting the thoracic and lumbar vertebrae are assembled therebetween by means of joints 11 allowing eased forward rotations to the motor biker during his/ her (preferably sports-related) activity.

The garment thus structured according to the present invention has, following falls and/or impacts against obstacles, an operation which is easy to guess, the former being of utmost simplicity in its components, which are already partially known to the art. Moreover, said garment is easily manufacturable, applicable and usable.

The garment 3 is worn by the user (not shown) and is initialized activating the electronic unit 5 with the operation keys 4 and the display 2, accessible to the motor biker's field of vision, which indicates and informs about the on-line state of the entire protective structure.

In the instant when suddenly and accidentally a more or less violent fall and/or injurious impacts against obstacles of various nature and shape, the acceleration sensors sense the imminent danger under way and within several milliseconds trigger with electric pulses solenoid valves of the gas sources 1, which activate the concomitant inflation of the pockets 9,12 and 15. The latter pockets, enveloping the motor biker carry out the actual protective intervention in hazardous situations, so as to cushion the impact of the human body against the obstacle.

The presence of the substantially rigid structure of the back protector 16 and 19 allows to limit the hazardous compressions generated onto a motor biker's body in presence of a very sudden inflation.

Moreover, the fabric of the inflatable pockets 9, 12, 15 besides inherent qualities of elasticity and of low specific weight should also have as useful characteristics a certain porosity, so as to allow the removal and the outflow of the inflation gas, preferably inert, both during the impact, so as to cushion the latter, and after a certain time interval from the occurred inflation.

Advantageously, the gas sources 1 are firmly positioned between the pockets 9,12,15 and the back protector structure 16,18,19 in order to protect to the utmost a motor biker's body in presence of remarkably violent impacts against obstacles of various sorts.

On the other hand, the acceleration sensors comprise an elastic lamina, constrained and incorporated into the support of the electronic unit 5, an electric charge generating device being formed onto a different lamination thereof. This electric charge generating device is formed with a thick film deposition process and it comprises a base layer and a continuous dielectric covering layer having piezoelectrical features, an intermediate conductive layer in form of a pair of interdigital electrodes being comprised therebetween.

The acceleration sensor, preferably obtained by depositions of subsequent paste (ink) layers with simple printing processes, refers to a highly simplified acceleration sensor having very short response times with respect to the known mechanical sensors; hence, the latter is applicable in an extremely simple way to the electronic unit 5, the latter being associated to the jacket 3.

It is known that the acceleration sensor is a passive safety device, i.e., it triggers those actions apt to minimize the hazardous consequences on the motor biker in case of impact of his/her motor vehicle. Said impact sensor should activate the safety means (compressed gas generators for the inflation) merely in the case of an impact of an entity exceeding a certain predetermined threshold, over very short time intervals. Therefore, those sensors incorporated in the electronic unit 5 should first of all be capable of sensing the acceleration change in the motor vehicle, discriminating those due to a normal, though in particular sharp, driving, or to minor non-injurious impacts, from those related to a real accident.

Last but not least, said sensors should be capable of responding within very short time intervals, i.e., prior to the occurrence of injurious consequences on the motor biker that are desirably prevented. Moreover, said acceleration sensors should have a high reliability level over time, so as to rule out any malfunction thereof, which of course in the field of safety would be particularly unwelcome.

In fact, after a lengthy testing the present Inventor has formed an electronic unit 5 incorporating, in an advantageous polymer matrix, said sensors which operate a faultless protection over time and with a reasonable manufacturing cost so that the application thereof be not merely limited to high-price motor vehicles, as it is at present.

Hence, the object of the present applicant has been to contrive an acceleration sensor having very short response times, inexpensive and highly reliable, successfully usable in impact sensing devices which activate passive safety devices and means in the field of the motor vehicles, or in likewise hazardous fields.

In the practical manufacture, the acceleration sensors are completed with shielded cables activating the connections to the cables 7, or to the fiber optics, or to the fiber optics sensors for the operation of the protective means. By virtue of the laminar shape of the sensing members, the acceleration sensors have remarkable features of directionality. Thus, it is possible, e.g., to exclusively sense the accelerations coming from a determined direction, or to arrange two or more sensors, for a practical embodiment of the present invention, according to respectively orthogonal directions and, by suitably processing the signals outputted therefrom into the electronic unit 5, to determine the precise direction of provenance of the acceleration, in order to advantageously control the protective means to respond in a fully satisfactory way to an accidental impact, or crash. Lastly, the high directionality of the acceleration sensors allows more sophisticated applications, in which different protective means are activated, not merely as a function of the acceleration gradient over time, but also according to the direction of the impact.

Thus, e.g., the acceleration sensors between the motor biker and the motor vehicle, as well as the conductive fibers or the fiber optics advantageously incorporated inside of the composite textile structure of the gilet and of the jacket are not represented as, though differently implementable, are already known to the art.

Moreover, the circuitry of such protective structure are not shown nor described, since differently implementable, according to the known state of the art.

Of course, the invention hereto proposed by means of an original solution is not limited to the mere embodiment of this garment, hereto disclosed by way of example, encompassing instead all the variants deriving from the same principle and which may differ in various constructive forms, and it is apparent that all of the technically equivalent solution, in particular for the implementation of the protective, control and use means, fall within the protective scope of the present invention.

What is claimed is:

1. A multi parts garment, in particular for motor bikers or for athletes of various sports, comprising:

protective means for the protection of the user against traumas and fractures from falls and/or impacts against obstacles;

a garment in form of a jacket manufactured in a natural or synthetic material, said jacket having seam sections made in a yarn with a preset specific breaking values of a tearing tension upon operation of said protective means;

a gilet manufactured in a flexible composite material, close-fitting and joined with zippers to the inner wall of said jacket so as to internally house said protective means between said jacket and said gilet, said gilet having regions in form of seams resisting to the breaking thereof from a tearing tension upon operation of said protective means; and a back protector for protecting the spine, in a polymeric material, having a substantially rigid structure, apt to be arranged in a respective central pocket obtained internally to the gilet.

2. The garment according to claim 1, wherein said protective means comprises at least one pocket in a double-wall resisting fabric and apt to be inflated following an impact or a marked deceleration of the motor biker, said at least one pocket being arranged at the central back- and side-covering area of the jacket, and apt to cooperate with said back protector, the arrangement being such that said at least one pocket be, following the inflation thereof, apt to envelop substantially the thoracic and the lumbar parts of said motor biker.

3. The garment according to claim 2, wherein said protective means comprises at least one high-pressure gas source connected to said at least one pocket.

4. The garment according to claim 1, further comprising:

an electronic unit integral to the jacket and apt to receive pulses from acceleration sensors both of the motor biker and of the motor vehicle;

a connecting circuit between the electronic unit and the gas source; and at least one solenoid valve connected to said gas source apt to cooperate with said electronic unit, when the latter receives a pulse from an acceleration sensor.

5. The garment according to claim 4, wherein said unit comprises:

a sensor overriding device; and a display onto the wall of the jacket in a position accessible to the motor biker's field of vision.

6. The garment according to claim 1, wherein said seam sections made in a yarn having preset specific breaking values of tearing tension thereof are aligned in total overlapping to said at least one pocket underlying the gilet, the arrangement being such as to allow the full expansion of said at least one pocket following a sudden inflation thereof and the breaking of said seams.

7. The garment according to claim 1, wherein said at least one pocket in a deflated state is contained and enveloped by fabric gathered in a position underlying said seam sections onto the jacket, and said fabric being porous in a mesh-like structure in order to elastically stabilize the same to a sudden inflation thereof.

8. The garment according to claim 1, wherein said at least one pocket is manufactured in a material having a predetermined porosity apt to allow the flow from inside thereof of the inflation gas during an impact against an obstacle as well as after a certain time interval from the triggering of the inflation of the same.

9. A garment according to claim 1, wherein said at least one gas source is firmly positioned between said at least one pocket and said back protector.

10. The garment according to claim 9, wherein said at least one gas source is a small-size bottle provided with coupling and releasing members apt to cooperate with said at least one pocket when arranged in said back protector.

11. The garment according to claim 4, wherein the acceleration sensors between the motor biker and the motor vehicle are selected from a group comprising:

inertia switch mechanical sensors; and magnetic retention sensors, said sensors being processed for sensing impacts within response times in the order of a few milliseconds.

12. The garment according to claim 4, wherein the acceleration sensors between the motor biker and the motor vehicle comprise electronic-type, piezoelectric and piezoresistive sensors having a laminar shape and apt to determine the exact direction of provenance of the acceleration according to respectively orthogonal directions.

13. The garment according to claim 1, wherein said jacket and said gilet is made of a textile material having a composite structure with conductive fibers in a quantity such as to exhibit an uniform electrical continuity.

14. The garment according to claim 13, wherein inside said textile composite material of the jacket and of the gilet fiber optics, or fiber optics sensors, are incorporated.

15. The garment according to claim 14, wherein the fiber optics are connected to an optoelectronics instrumentation of said unit.

16. The garment according to claim 15, wherein the inlets and the outlets of each fiber optics from the gilet and/or the jacket are protected by small rubber disks glued onto the surface thereof.

17. The garment according to claim 1, comprising three inflatable pockets.

18. The garment according to claim 17, comprising three compressed gas sources, each thereof being connected to a respective pocket.

* * * * *